US009488001B2

(12) United States Patent
Cherevko et al.

(10) Patent No.: US 9,488,001 B2
(45) Date of Patent: Nov. 8, 2016

(54) LADDER STABILIZING TOOL

(71) Applicants: Piotr Cherevko, Hartville, OH (US); Nikolai Cherevko, Hartville, OH (US)

(72) Inventors: Piotr Cherevko, Hartville, OH (US); Nikolai Cherevko, Hartville, OH (US)

( * ) Notice: Subject to any disclaimer, the term of this patent is extended or adjusted under 35 U.S.C. 154(b) by 0 days.

(21) Appl. No.: 14/717,384

(22) Filed: May 20, 2015

(65) Prior Publication Data

US 2015/0337596 A1 Nov. 26, 2015

Related U.S. Application Data

(60) Provisional application No. 62/000,766, filed on May 20, 2014.

(51) Int. Cl.
*E06C 1/06* (2006.01)
*E06C 7/48* (2006.01)

(52) U.S. Cl.
CPC . *E06C 1/06* (2013.01); *E06C 7/48* (2013.01); *Y10T 29/49828* (2015.01)

(58) Field of Classification Search
CPC ..... E06C 7/08; E06C 7/085; E06C 7/48; E06C 7/488; E06C 1/345; E06C 5/36
See application file for complete search history.

(56) References Cited

U.S. PATENT DOCUMENTS 4,179,011 A * 12/1979 Morawski ..... E06C 7/488 182/206
5,165,501 A * 11/1992 Donahey ..... E06C 7/42 182/107
5,242,031 A * 9/1993 Ashley ..... E06C 7/48 182/129
5,358,071 A * 10/1994 Stennett ..... E04D 13/12 182/107
5,743,356 A * 4/1998 Mitchell ..... E06C 7/48 182/107
5,775,465 A * 7/1998 Vossler ..... E06C 7/48 182/107
5,941,343 A * 8/1999 Kelsey ..... E06C 7/182 182/107
6,722,469 B1 * 4/2004 Weger, Jr. ..... E06C 1/34 182/107
6,851,518 B1 * 2/2005 Walker ..... E06C 7/48 182/107
8,839,907 B2 * 9/2014 Davis, Jr. ..... E06C 7/182 182/106
8,839,908 B2 * 9/2014 Davis, Jr. ..... E06C 7/188 182/106
2002/0134619 A1 * 9/2002 Schwenke ..... E06C 1/34 182/107
2005/0139425 A1 * 6/2005 Thomas ..... E06C 1/34 182/214
2008/0011375 A1 * 1/2008 Soubjaki ..... F16L 55/1141 138/89
2008/0302934 A1 * 12/2008 Nelson ..... E04D 13/12 248/237
2009/0255759 A1 * 10/2009 Barnes ..... E06C 7/48 182/204
2015/0204140 A1 * 7/2015 Umlor ..... E06C 7/486 182/165

OTHER PUBLICATIONS

AC78 Quickclick Stabilizer, http://www.wernerco.com/us/view/Products/Climbing-Eqiupment/Accessories/AC78/AC78.

* cited by examiner

*Primary Examiner* — Katherine Mitchell
*Assistant Examiner* — Candace L Bradford
(74) *Attorney, Agent, or Firm* — Sand & Sebolt; Howard L. Wernow

(57) ABSTRACT

A ladder stabilizing tool for use with an extension ladder may include a U-shaped brace coupled to a ladder grasping member. A pair pivotable of feet may be attached to the ends of U-shaped brace permitting the stabilizing tool to secure an extension ladder to a roof at any slope between zero and ninety degrees. The grasping member has a pair of tapered supports configured to fit within the apertures formed in the rails of an extension ladder. The stabilizing tool ensures stability of the ladder for the safety of an operator, while further providing clearance from any gutter attached to housing fascia.

12 Claims, 6 Drawing Sheets

LADDER STABILIZING TOOL

CROSS REFERENCE TO RELATED APPLICATION

This application claims the benefit of U.S. Provisional Patent Application Ser. No. 62/000,766, filed May 20, 2014; the disclosure of which is entirely incorporated herein by reference.

BACKGROUND

Technical Field

The present disclosure relates generally to the field of construction equipment and safety devices. More particularly, the present disclosure relates to safety devices for stabilizing extension ladders. Specifically, the present disclosure relates to a selectively attachable extension ladder stabilizing tool that is securable to any surface between zero and ninety degrees.

Background Information

Extension ladders are useful tool permitting a person to climb to an elevated height, such as an inside ceiling or even a roof, amongst other places. Extension ladders ordinarily consist of a pair of vertically extending support rails having steps (also known as "rungs") spaced at regular vertical intervals therebetween. Although, they are extremely useful, there is some risk associated with climbing an extension ladder. The ladder should be firmly placed on level ground to reduce the risk of the ladder tipping over when a person has scaled to the top of the ladder.

Some devices exist to assist in stabilizing an extension ladder. One such example is the aluminum ladder stabilizer available commercially for sale by Werner® Corporation of Greenville, Pa. The Werner® stabilizer is generally a U-shaped support releasably attached proximate the top of a ladder and configured to contact a vertical sidewall inside a home, such as when a person needs to paint a high ceiling inside their home.

SUMMARY

Issues continue to exist with the extension ladder stabilizers currently available. By way of non-limiting example, present extension ladders fail to provide adequate safety and stability for a person needing to elevate to a sloped surface (i.e., a roof). Further, they lack the ability to secure the ladder to a roof, they are designed to merely rest against a wall. Even further, these prior art devices are difficult to connect, disconnect, then re-connect to the ladder. The present disclosure addresses these and other issues.

In one aspect, an embodiment may provide a ladder stabilizing tool comprising: a U-shaped brace; a ladder grasping member coupled to the U-shaped brace; and at least one pivotable foot at an end of the U-shaped brace.

In another aspect, an embodiment may provide a ladder stabilizing tool comprising: two pivotable roof engaging feet; and a pair of tapered support members coupled to the feet and adapted to engage two apertures formed in rails of an extension ladder.

In another aspect, an embodiment may provide a method of stabilizing a ladder comprising the steps of: providing a ladder stabilizing tool including a u-shaped brace, a ladder grasping member coupled to the U-shaped brace, and at least one foot coupled to the U-shaped brace; positioning the foot on a shingle on a roof; and securing the foot to the roof.

In yet another aspect, an embodiment may provide a method of stabilizing a ladder comprising the steps of: providing a ladder stabilizing tool including a u-shaped brace, a tapered support on a ladder grasping member coupled to the U-shaped brace, and at least one foot coupled to the U-shaped brace; and inserting the tapered support into an aperture formed in a rail of an extension ladder.

Still another aspect of an embodiment may provide a ladder stabilizing tool comprising: a brace having left and right sides defining a lateral direction therebetween; and a ladder grasping assembly having a selectively variable lateral length coupled to the brace; wherein the brace releasably engages a roof and the ladder grasping assembly releasably engages a ladder adjacent a rung to stabilize an upper portion of the ladder a relative to the roof.

In another aspect, an embodiment may provide a method comprising the steps of: providing a ladder stabilizing tool including a first support block and a second support block; inserting a portion of the second support block into a hole defined by a ladder rung; increasing a lateral length of the tool; maneuvering the first support block to align with an opposed hole defined by the ladder rung; and inserting a portion of the first support block into the opposed hole while simultaneously decreasing the lateral length of the tool. This method may further include the steps of: positioning a pair of feet on a roof, wherein the feet are connected to respective ends of a U-shaped brace, wherein the brace is operatively coupled to the first and second support blocks; and securing a truss anchor to a roof truss. This method may also include wherein there are a pair of truss anchors, one truss anchor pivotably connected to one foot, further including the steps of: pivoting one truss anchor from a retracted first position and an extended second position; aligning an innermost portion of a slot formed in the truss anchor over the roof truss; and driving a nail through the slot into the roof truss to secure the truss anchor to the roof truss. This method may also include the steps of impacting a lug on the truss anchor to dislodge the truss anchor from the nail; and covering a head of the nail with a shingle on the roof.

In another aspect, an embodiment may provide a ladder stabilizing tool for use with an extension ladder may include a U-shaped brace coupled to a ladder grasping member. A pair pivotable of feet may be attached to the ends of U-shaped brace permitting the stabilizing tool to secure an extension ladder to a roof at any slope between zero and ninety degrees. The grasping member has a pair of tapered supports configured to fit within the apertures formed in the rails of an extension ladder. The stabilizing tool ensures stability of the ladder for the safety of an operator, while further providing clearance from any gutter attached to housing fascia.

BRIEF DESCRIPTION OF THE SEVERAL VIEWS OF THE DRAWINGS

A sample embodiment is set forth in the following description, is shown in the drawings and is particularly and distinctly pointed out and set forth in the appended claims. The accompanying drawings, which are incorporated in and constitute a part of the specification, illustrate various example methods, and other example embodiments of various aspects of the present disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
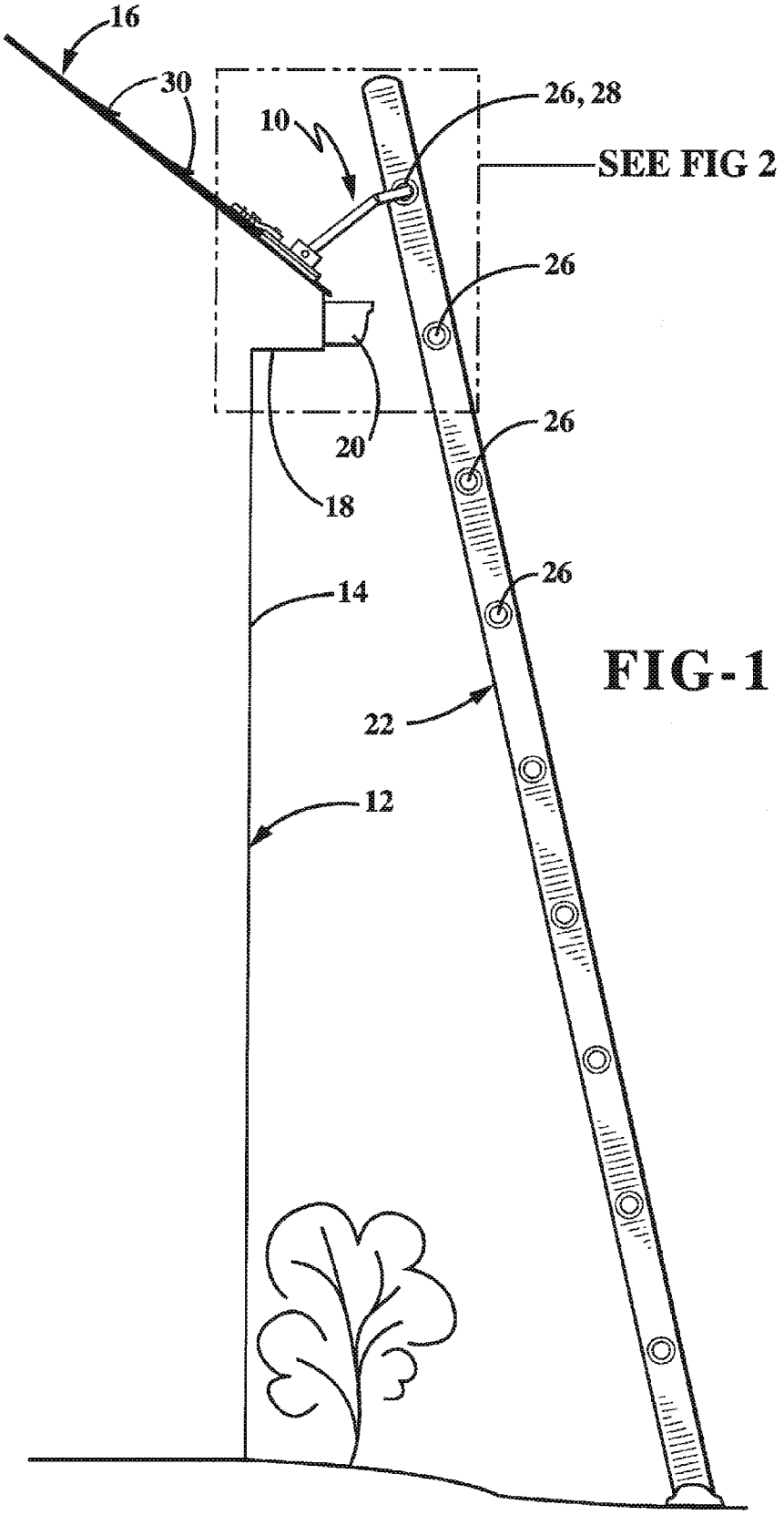
FIG. 1 is a side elevation environmental view of one embodiment a ladder stabilizing tool securing an extension ladder to a roof.
Figure 2:
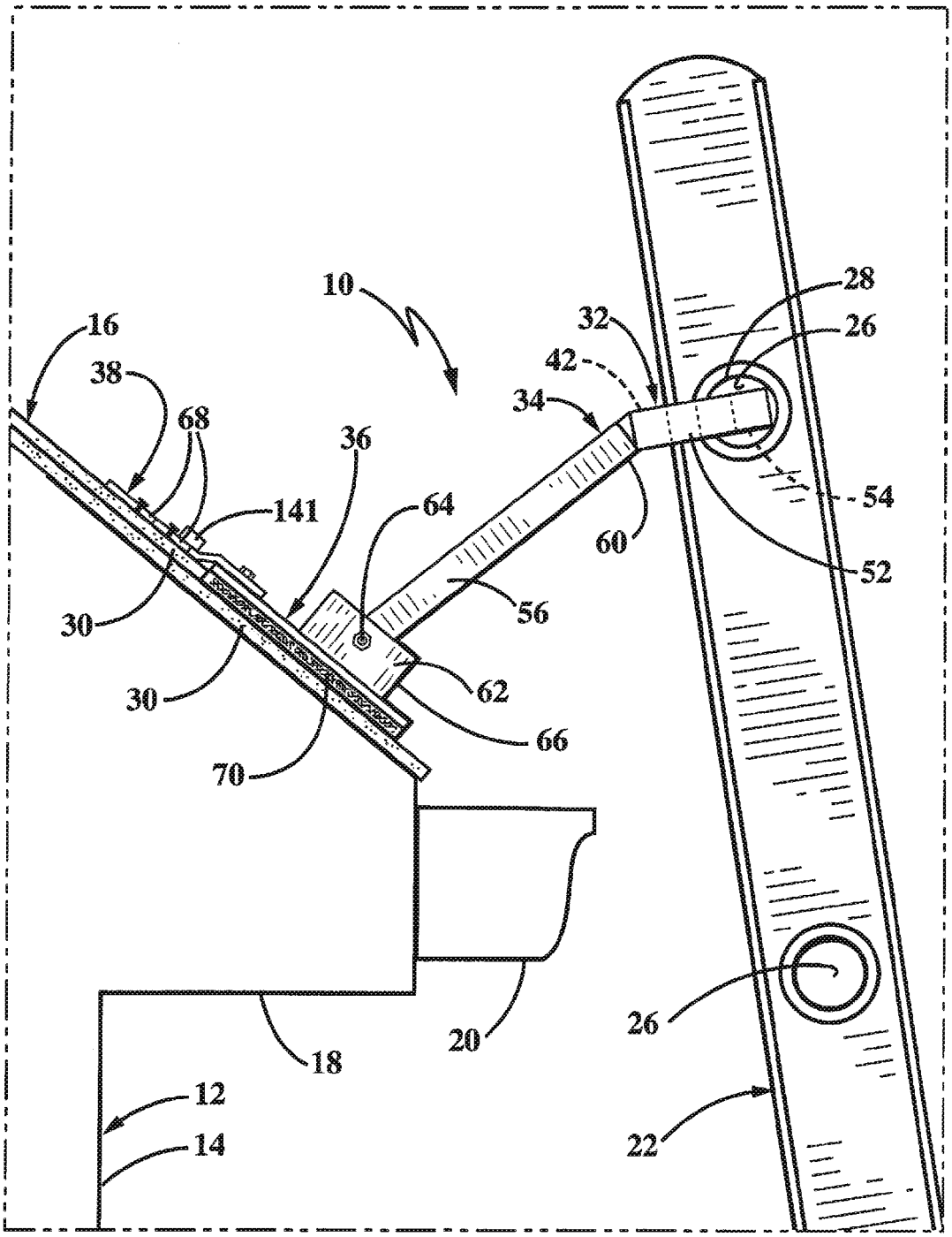
FIG. 2 is an enlarged side elevation view of the are labeled "SEE FIG. 2" in FIG. 1.

A ladder stabilizing tool or brace is depicted throughout FIGS. 1-7 and is shown generally as 10. Stabilizing tool 10 releasably secures and stabilizes a ladder 22 to a house 12 enabling a worker to scale ladder 22 in a relatively safe manner.

By way of further background, house 12 typically includes a vertically extending sidewall 14 and a sloped roof 16. Roof 16 is covered with a plurality of shingles 30 in a conventional shingled manner. House 12 further includes an outwardly extending soffit 18 and a gutter 20 connected to the fascia below the roof 16.

Ladder 22 includes a pair of upwardly extending support side rails that therebetween have a plurality of conventional steps or ladder rungs 24. Each respective ladder step or rung 24 defines apertures 26 formed in the side rails of ladder 22. In one particular embodiment, tool 10 is configured to attach to the uppermost step 28 in order to secure ladder 22 to roof 16 of house 12.

Figure 3:
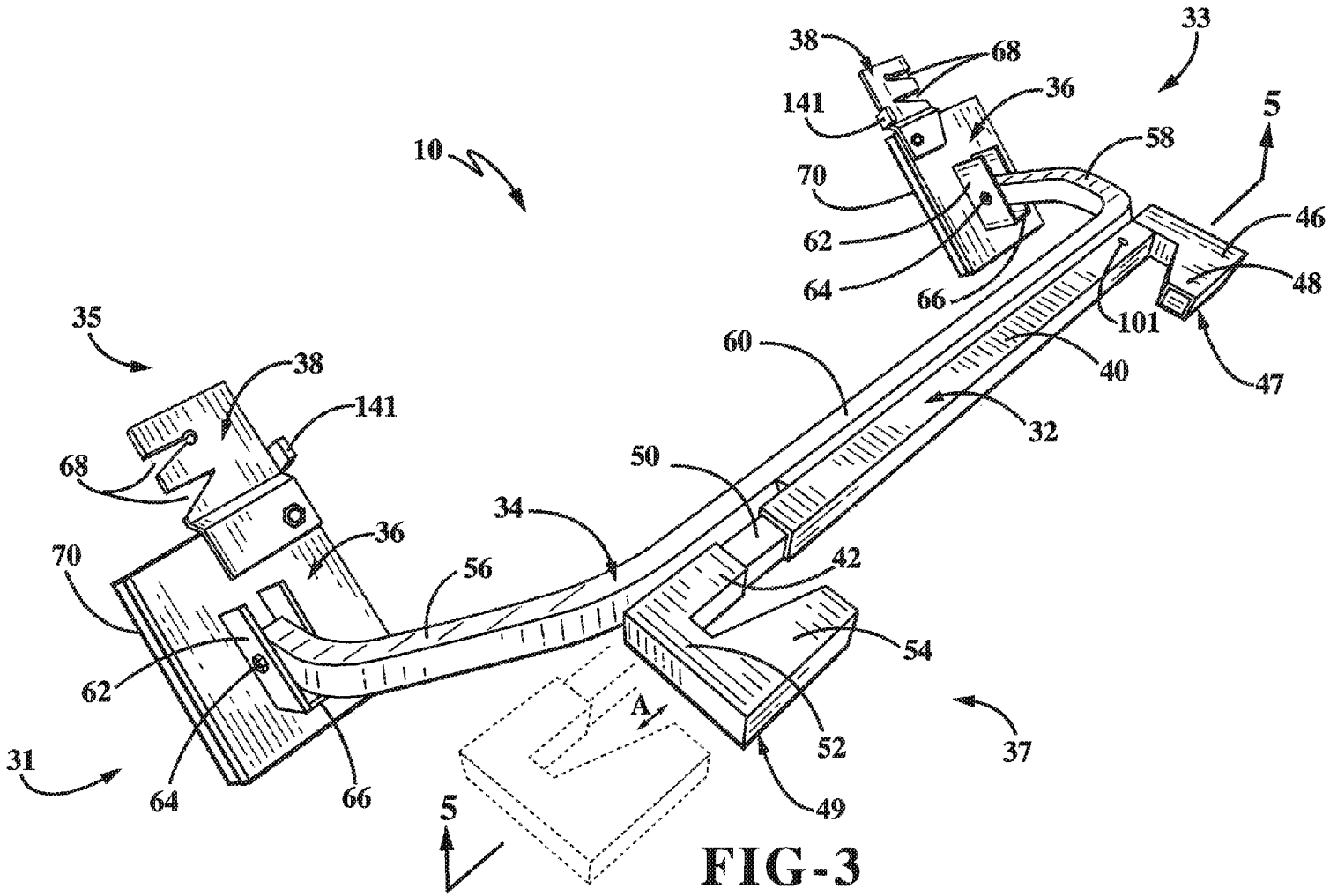
FIG. 3 is a side perspective view of the ladder stabilizing tool.

As depicted in FIG. 3, ladder stabilizing tool 10 includes a ladder grasping assembly 32, a U-shaped brace 34, a pair of feet 36, and a pair of truss anchors 38. Tool 10 includes a left side 31 and a right side 33 defining a lateral direction therebetween. A forward end 35 on tool 10 is spaced from a rearward end 37, wherein when tool 10 is in use, the forward end 35 is closely adjacent shingles 30 on roof 16 and the rear end 37 is closely adjacent step 24 on ladder 22.

Ladder grasping assembly 32 includes a first tubular member 40, a first support block 47, and a second support block 49. First tubular member 40 is aligned laterally between first and second support blocks 47, 49. The longitudinal length of first tubular member 40 extends laterally from a first end adjacent first block 47 to a second end adjacent second block 49. Member 40 is hollow having a square configuration in cross section, however other configurations are entirely possible. Member 40 defines a hole 101 near the first end of member 40 in the upwardly facing top surface of member 40. A second hole 103 may be defined in the downwardly facing bottom surface of member 40. Further, first and second holes 101, 103 may be vertically aligned to receive a securing member (i.e., a screw) therethrough.

The second end of member 40 receives therein a portion of a laterally extending rigid member 50. Rigid member 50 is fixedly connected to moveable second support block 49, such that wherein the rigid member 50 moves in unison with second support block 49. Rigid member 50 has a cross sectional configuration complementary to the hollow portion of the member 40 but is slightly smaller in diameter which allows rigid member 50 to slidably be received by member 40. In one particular embodiment, rigid member 50 is centered along a same laterally extending central axis as member 40. When rigid member 50 is disposed within member 40, rigid member 50 and tubular member 40 cannot rotate relative to each other.

First support block 47 includes a leg portion 46 and a tapered support portion 48. Tubular member 40 connects with first support block 47 adjacent a forward end of leg portion 46. Leg portion 46 extends rearwardly from adjacent the first end of member 40. Tapered portion 48 extends laterally in the same general direction as tubular member 40 from a rigid connection with leg 46. Tapered portion 48 is configured to taper at an angle permitting insertion into aperture 26 on ladder 22. Tapered portion 48 tapers from wide-to-narrow, wherein the wider base section of tapered portion 48 is adjacent leg 46 and the narrow portion of tapered portion 48 is spaced away from leg 46 near an innermost end wall. Further, tapered portion 48 is configured to fit within any conventional ladder aperture 26 diameter. When first support block 47 is connected to member 40, the two connected components are generally J-shaped.

Second support block 49 includes a laterally extending leg portion s, a rearwardly extending leg portion 52, and a second tapered support portion 54. Second support block 49 is also generally J-shaped. Leg portion 42 fixedly connects with rigid member 50 and is laterally aligned with tubular member 40 centered about a similar lateral axis. Leg portion 52 extends rearwardly from a rigid connection with lateral leg portion 42 in the same direction as leg 46. Second tapered portion 54 extends laterally in the same direction as rigid member 50 from leg portion 52. Second tapered portion 54 is shaped in a manner complementary to first tapered portion 48, tapers from wide-to-narrow, and is configured to fit through an opposed hole 26 on a ladder 22 opposite that of tapered portion 48.

As depicted in FIG. 3, second support block 49 is selectively movable in relation to first tubular member 40 in the lateral direction of Arrow A. The selective movement of second support block 49 in the lateral direction alters the longitudinal length of grasping assembly 32. Stated otherwise, grasping assembly 32 has a selectively variable length depending on the position of second support block 49. In one particular embodiment a spring is disposed within tubular member 40 operatively connecting first support block 47 to second support block 49. Moving second support block 49 outward (e.g., to the left) in the direction of Arrow A allows second tapered portion 54 to selectively engage and disengage the ladder 22 as desired by the user. The spring connection is discussed in greater detail below with respect to FIG. 6.

Moveable second support block 49 is associated with the left side of tool 10. This is advantageous inasmuch as nearly 90% of the human population is right handed. Thus, when an operator (e.g., a roofer) scales the ladder, the right side 33 of tool 10 is grasped with a right hand of the operator and the second support block 49 is selectively secured to the left side of ladder 22 by inserting tapered portion 54 through hole 26. With second block 49 releasably secured to the left side of ladder 22, the tool 10 may be pulled against a spring force by user's right hand laterally, wherein the longitudinal lengthwise extension of grasping assembly 32 allows first support block 47 to maneuver around the right side of ladder 22 where first tapered portion 48 is aligned with hole 26 on ladder 22 at a same height as the left side of tool 10. The spring then pulls support blocks 47, 49 laterally towards each other in the direction of Arrow A.

Turning now to U-shaped brace 34, brace 34 includes a first leg 56 spaced apart and shaped complimentary to a second leg 58 and connected therebetween by a laterally extending longitudinal member 60. First and second legs 56, 58 extend both laterally and forwardly from grasping assembly 32. Brace 34 is wider than grasping assembly 32, providing a stable base for tool 10 on roof 16. Brace 34 is shown in this particular non-limiting embodiment as constructed from hollow tubing preformed and bent to define the U-shape. U-shaped brace 34 includes a first end spaced apart from a second end and the first and second ends facing generally the same forward direction. U-shaped brace 34 is coupled to ladder grasping assembly 32. In one particular embodiment member 60 is coupled to tubular member 40 via a laterally extending weld extending between member 60 and member 40. Relative to the weld, first and second ends of brace 34 are spaced apart and opposite from tapered supports 48, 54.

A pair of feet 36 is each respectively coupled to the first and second ends of brace 34. Foot 36 includes a roof engaging first surface opposite a second top surface. Roof engaging first surface is configured to contact shingles 30 on roof 16. Each of the first and second surfaces of foot 36 are bound by 4 inner-connected edges defining the general shape of a rectangle, however, clearly it is contemplated that other geometric configurations are entirely possible. A mounting bracket 62 extends upwardly from second top surface of foot 36. Mounting bracket 62 is configured to couple a respective first or second end of brace 34 to foot 36. The coupling relationship is pivotable permitting pads to rotate about pivot 64. The pivotable engagement permits foot 36 to contact a sloped roof at any angle between zero and ninety degrees relative to horizontal. Each foot may independently pivot relative to the other foot, however it is most likely that the feet with be at the same slope angle for maximum stability. A pivot limiter or governor 66 extends between two vertical walls of the mounting bracket 62 in order to prevent brace 34 from pivoting below zero degrees relative to horizontal. A pad 70 may be included to cover the roof engaging first surface. Pad 70 may be constructed from rubber or other similar polymer materials that enable pad 70 to grip roof 16. In one particular embodiment, pad 70 is rubber which provides sufficient grip strengths for three-tab or asphalt shingles 30, a clay or terracotta tile, or a metal roof.

A truss anchor 38 is coupled to foot 36. Truss anchor 38 includes a first roof engaging surface spaced apart and opposite from an upwardly facing second surface. Roof engaging surface of truss anchor 38 is flush with first surface of foot 36 when viewed from the side. Roof engaging surface of truss anchor 38 may alternatively be flush with pad 70 when viewed from the side. Truss anchor 38 defines at least one slot 68. Slot 68 is configured to receive a nail therethrough. The inner most portion of slot 68 is spaced apart two feet from the respective inner most part, slot 68 on the other truss anchor 38 coupled to the other foot 36.

Ordinarily, during roof construction, a roof truss 72 is spaced apart (e.g. a bay distance) two feet (24 inches) on center from another truss 72. The intentional spacing of slot 68 two feet (24 inches) apart permits an operator to drive a nail directly into the center of roof truss 72 to firmly anchor tool 10 to roof 16 ensuring stability, safety, and gutter 20 clearance.

Figure 4:
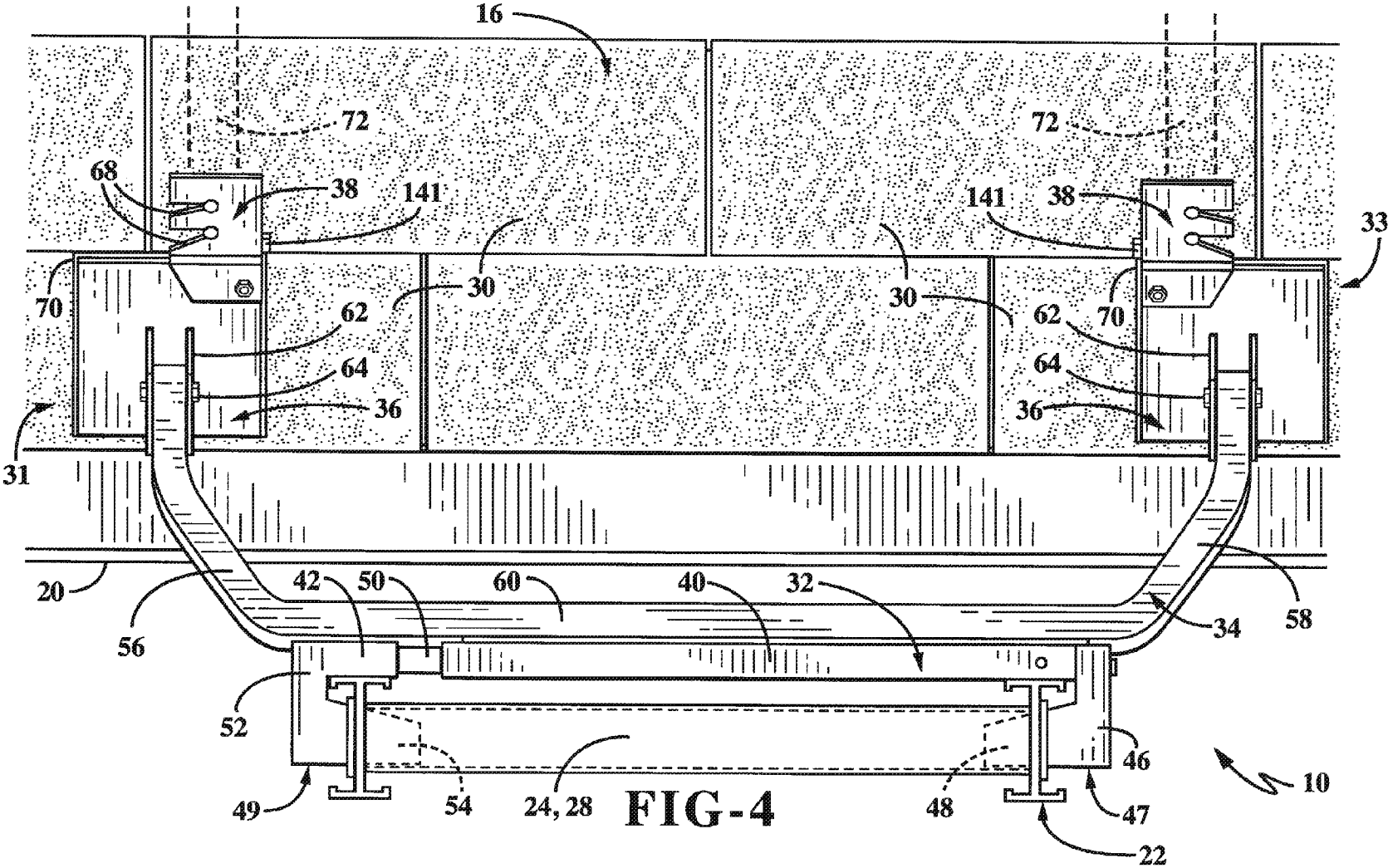
FIG. 4 is top view of the ladder stabilizing tool coupled to the ladder and mounted on the roof.

Truss anchor 38 is pivotally connected to foot 36. Truss anchor 38 may pivot about a pin or screw between a retracted first position and an extended second position (FIG. 4). When in the retracted first position, truss anchor 38 is closely adjacent foot 36, either above or below foot 36. When truss anchor is in the extended second position, the truss anchor extends forwardly from a forward edge on foot 36. In one particular embodiment, truss anchor 38 is pivotable about a coupling screw. The coupling screw permits anchors 38 to rotate and fold-away adjacent foot 36 when the anchor 38 is not in use.

A lug 141 extends upwardly from the upwardly facing second surface on truss anchor 38. In one embodiment, lug 141 extends upward from a rigid connection with an innermost edge (wherein "innermost" refers to being the closest edge to the other truss anchor when are pivoted into the extended position). The lug 141 performs at least two functions. First, when truss anchor 38 is in the extended second position, and a nail has been driven through slot 68 securing anchor 38 to truss 72, lug 141 provides a striking surface against which a hammer is impacted. The impact of a swinging hammer against lug 141 releases (e.g., knocks loose) the engagement of anchor 38 and truss 72. Then, the tool 10 may be moved to another portion of the roof and re-secured. Secondly, when truss anchor is in the retracted first position, lug 141 acts as a stop block to prevent truss anchor 38 from over-rotating or over-pivoting which may cause undue stress on the pivot screw.

Figure 5:
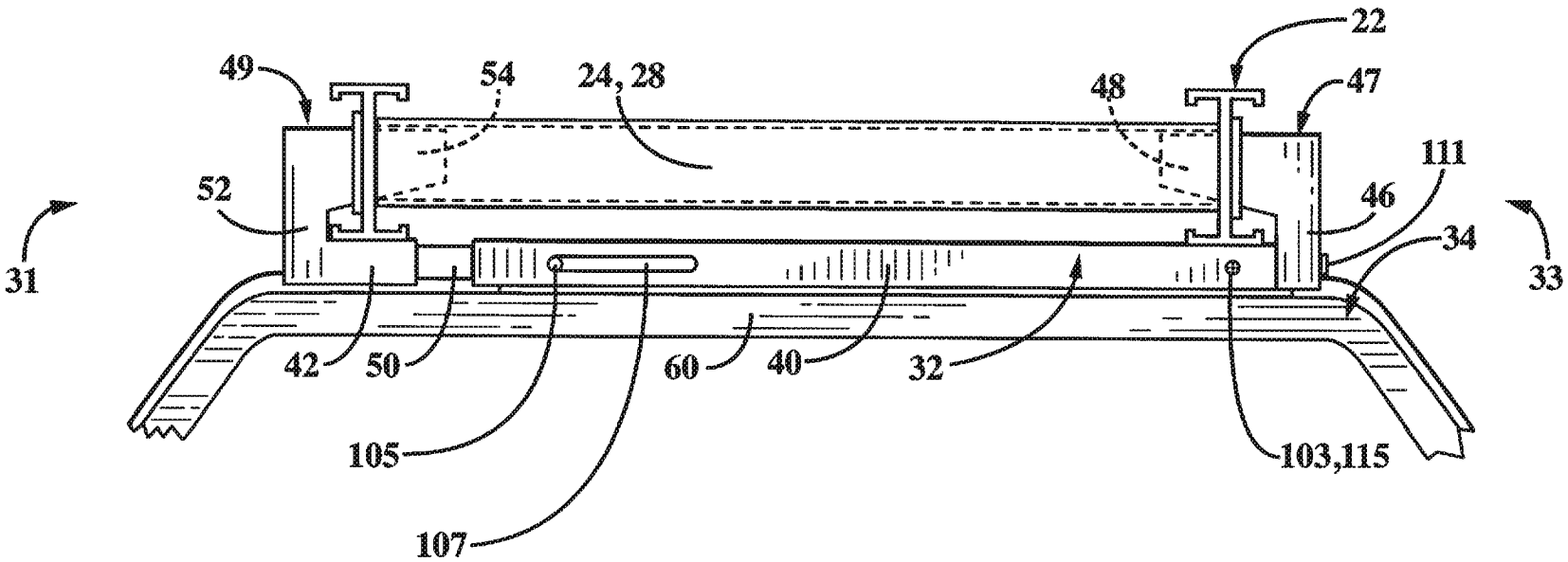
FIG. 5 is a bottom view taken from line 5-5 in FIG. 3.

As depicted in FIG. 5, tubular member 40 defines a slot in its downwardly facing bottom surface. Slot 105 extends laterally from adjacent the second end of tubular member 40 towards the first end of tubular member 40. Slot 105 is in open communication with the hollow inner bore of tubular member 40. A pin 107 extends outwardly from a rigid connection with rigid member 50 and is disposed within slot 105 and is configured to slide therein. Pin 107 slides in slot 105 as second support block 49 is moved against a spring force as described above. Pin 107 sliding within slot 105 prevents rigid member 50 from sliding to far in one lateral direction relative to tubular member 40.

Figure 6:
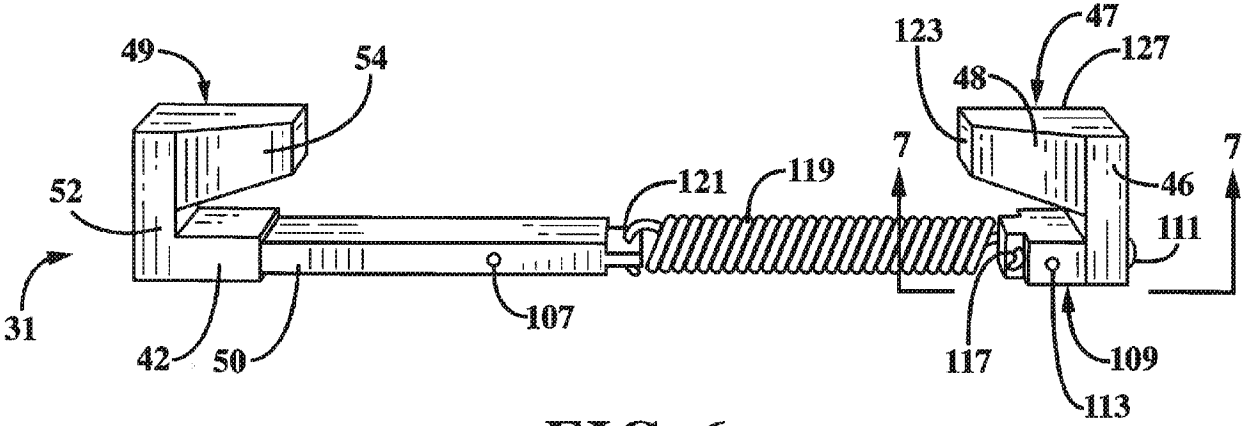
FIG. 6 is a perspective view of operational components of a grasping member.

As depicted in FIG. 6, some components of grasping assembly 32 are provided in more detail. Some of these components described below are disposed within the hollow bore of tubular member 40 when tool 10 is fully assembled. First support block 47 is mechanically secured to a T-block 109 via screw 111. T-block 109 defines a bore 113 extending therethrough. When assembled, T-block 109 is inserted into the first end of tubular member 40 such that bore 113 aligns with first hole 101 and second hole 103 allowing a screw 115 to be inserted through the aligned holes securing T-block 109 within tubular member 40 in a fixed manner. The base leg of T-block 109 defines an anchor point 117. As will be described in greater detail below, anchor point 117 attaches one end of a spring to T-block 109.

An extension coil spring 119 is laterally aligned with rigid member 50 extending between first support block 47 and an end of rigid member 50. Spring 119 is disposed within the hollow bore of tubular member 40 when tool 10 is fully assembled. A first end of extension spring 119 is secured to anchor point 117 on T-block 109. In the shown manner, extension coil spring 119 is hooked through an aperture on T-block 109 however other conventional manners of coupling a spring to a block are entirely contemplated. A second end of extension spring 119 is secured to a second anchor point 121 on rigid member 50. Similarly, second anchor point 121 is depicted as a hole formed in rigid member 50 allowing a portion of spring 119 to be threaded therethrough creating a secured connection however other conventional manners of connecting an extension spring to a rigid member are entirely possible.

Figure 7:
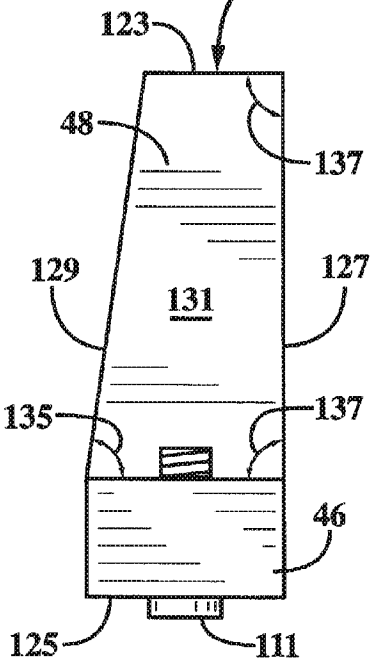
FIG. 7 is a view taken from line 7-7 in FIG. 6.

As depicted in FIG. 7, first support block 47 and second support block 49 are each configured as an oblique rectangular frusto-pyramid member. First support block 47 includes an inner most end wall 123 on tapered portion 48 and an outermost end wall 125 on leg 46. First support block 47 further includes a top wall 127 spaced opposite an acutely tapered bottom wall 129. In that sense, a side wall 131 tapers from the base portion of tapered portion 48 towards innermost end wall 123 opposite a back wall 133 that is generally orthogonal to innermost end wall 123. Similarly, bottom wall 129 tapers at an acute angle relative to leg portion 46 from the base of tapered portion 48 towards end wall 123 opposite top wall 127 extending from the base of tapered portion 48 orthogonal to leg portion 46 and orthogonal to end wall 123. The orthogonal relationship is represented by right angle 137. Bottom wall 129 defines an acute angle in a range from about 70° to about 85° relative to leg portion 46 when viewed from below. This acute angle is shown generally as 135. It is to be understood that second support block 49 is shaped in a similar manner reflected (i.e., mirrored) about a vertically extending imaginary center line of symmetry. Together, the angled portions of first support block 47 and second support block 49 cooperate together to allow grasping assembly 32 to be inserted into any size aperture 26 in a ladder 22, preferably on top rung 28.

In accordance with one aspect of the present disclosure, tool 10 ensures the safety of an operator when needing to climb upon a roof 16. Further, tool 10 provides additional stability over the ordinary stability of resting a ladder 22 against a roof 16 edge or against a metal gutter 20. Further, in accordance with another aspect of the present disclosure, tool 10 permits a user to climb up towards the roof 16 while being spaced away from gutter 20 thus reducing the likelihood of any gutter damage when needing to traverse roof 16.

In accordance with another aspect, tool 10 permits an operator to releasably install tool 10 on ladder 22 with only one hand. By fabricating moveable second support block 49 at the left side of tool 10, the operator can maneuver tool 10 in front of ladder 22 and insert second support block 49 into hole 26 of the uppermost step 28, then pull tool 10 to the right, forward of the ladder. The rigid member 50 is extracted from the bore of tubular member 40 to increase the laterally measured length of grasping assembly 32. The fixed first support block 47 is maneuvered into the hole 26 of the uppermost step 28 on the right side of ladder 22.

In operation and with respect to mounting tool 10 to ladder 22, a user will first align tool 10 with ladder 22 in a manner such that the feet 36 are facing away from the user and the support blocks 47, 49 are closest to the ladder 22. The tapered portion 54 on second support block 49 is inserted to an aperture 26 along the left rail of ladder 22. In one particular embodiment, tapered portion 54 is inserted into aperture 26 of the uppermost step 28. The user then pulls with their right hand to increase the laterally extending length of grasping assembly 32 against the force of spring 119 in the direction of Arrow A. The first support block 47 is then maneuvered around the right rail of ladder 22 and aligned with hole 26. The user allows spring 119 to draw blocks 47, 49 closer together narrowing the lateral length of grasping assembly 32. The tapered portion 48 on first support block 47 is guideably received by hole 26 on the right rail of ladder 22.

In operation and with respect to attaching tool 10 to roof 16 the user will ensure that feet 36 are placed on the lower most shingle layer 30 of roof 16. Alternatively, tool 10 may be attached to another shingle layer. As shown in FIG. 4, in one particular embodiment, feet 36 are approximately the same thickness as a single shingle. The pad 70 on first surface of feet 36 engages the bottom shingle layer 30. In one particular embodiment a secured engagement is ensured via pad 70 constructed from a polymer layer. Alternatively, pad 70 may be a felt material to provide a type of hook and loop closure with a conventional rough surface shingle. In another particularly non-limiting embodiment, pad 70 may be constructed of a natural rubber material which would also provide a secure engagement with both a conventional rough shingle or a tile roof shingle, or a wood shingle.

Truss anchors 38 are then pivotably swung from the retracted first position and the extended second position (FIG. 4). The user then finds a roof truss 72 and positions the innermost portion of slot 68 over the lateral center of truss 72. In order to secure tool 10 to roof, nails are driven through slot 68. The purposeful spacing of truss anchors 38 two feet on center permits easy alignment of the second anchor 38 after the first anchor has been nailed into a roof truss 72. When each truss anchor 38 has a nail driven through slot 68, tool 10 is secured to roof 16.

To remove tool 10 from its engagement with roof 16, the user impacts a hammer with a swinging force against lug 141. During impact, kinetic force is transferred from the hammer to lug 141. The transfer of energy disengages truss anchor from the nail. The user can then rotate/pivot the truss anchors from the extended second position back to the retracted and stored first position. During the pivoting of truss anchor 38 back to the retracted first position, lug 141 acts as a stop block to prevent over-rotation. Turning back to the exposed nail on the roof, a user may then hammer it town into the truss 72 and afterward the head of the nail may be covered with a shingle 30 such that it is not visible from the outside when tool 10 has been moved to another location on roof 16.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the invention are an example and the invention is not limited to the exact details shown or described.

What is claimed:

1. A ladder stabilizing tool comprising:

a brace having left and right sides defining a lateral direction therebetween;

a ladder grasping assembly having a selectively variable lateral length coupled to the brace;

wherein the brace releasably engages a roof and the ladder grasping assembly releasably engages a ladder adjacent a rung to stabilize an upper portion of the ladder relative to the roof;

a fixed first support block on the ladder grasping assembly having a tapered portion configured to be slidably received by a hole defined by the rung on the ladder;

a moveable second support block on the ladder grasping assembly having a tapered portion configured to be slidably received by an opposed hole defined by the rung on the ladder opposite the first support block;

a rigid member extending laterally from the moveable second support block to an end, wherein the rigid member moves in unison with the second support block;

a spring having two ends, a first end of the spring operatively connected to the rigid member, and the spring operatively connected to the fixed first support block;

wherein the fixed first support block is associated with the right side of the ladder stabilizing tool and the moveable second support block is associated with the left side of the ladder stabilizing tool; and wherein when the right side of the brace is grasped with a right hand of the operator and the moveable second support block is selectively secured to the hole defined by the rung on a left side of the ladder, the brace is pulled against a force of the spring to increase a lateral length of ladder grasping assembly and the first support block is maneuvered around a right side of the ladder and aligned with the opposed hole defined by the rung on a right side of the ladder, and the spring then pulls the first and second support blocks toward each other to contact the rung.

2. The ladder stabilizing tool of claim 1, wherein the fixed first support block includes a leg portion, and wherein the tapered portion comprises:

a side wall tapering from a wider base section towards a narrower innermost end wall, wherein the wider base section is rigidly connected to the leg portion;

a back wall opposite the side wall and orthogonal to the innermost end wall;

a bottom wall tapering at an acute angle relative to the leg portion from the wider base section towards the innermost end wall; and a top wall opposite the bottom wall extending orthogonal to the leg portion and orthogonal to the innermost end wall.

3. The ladder stabilizing tool of claim 1, wherein the acute angle is in a range from about 70° to about 85°.

4. The ladder stabilizing tool of claim 1, wherein the fixed first support block has an oblique rectangular frusto-pyramid configuration, wherein an innermost end wall on the first support block is disposed within the hole on the ladder.

5. The ladder stabilizing tool of claim 1, wherein the first and second support blocks are similarly shaped reflected about an imaginary line of symmetry.

6. The ladder stabilizing tool of claim 1, further comprising:

the brace having a U-shaped configuration with spaced first and second ends facing a forward direction; and a pair of feet including a first foot coupled to the first end of the brace and a second foot coupled to the second end of the brace.

7. The ladder stabilizing tool of claim 6, further comprising:

a mounting bracket on each respective foot pivotably connecting to the first and second ends on the brace, wherein each foot independently pivots in a range between 0° and 90° relative to horizontal.

8. The ladder stabilizing tool of claim 6, further comprising:

a pair of truss anchors, one truss anchor on each foot, wherein each truss anchor is pivotably moveable between a retracted first position and an extended second position and each truss anchor defines a laterally aligned slot in open communication with an edge of the truss anchor thereby allowing the truss anchor to pivotably disengage a nail hammered through the slot while the nail remains in place.

9. The ladder stabilizing tool of claim 8, further comprising:

a lug on each truss anchor, wherein the lug provides a striking surface for dislodging the truss anchor from the nail.

10. The ladder stabilizing tool of claim 1, further comprising:

a t-block connected to the fixed first support block; and a second end of the spring connected to the t-block.

11. The ladder stabilizing tool of claim 10, further comprising:

a tubular member having a bore, wherein the rigid member, the spring, and the t-block are disposed within the bore; and wherein the tubular member is rigidly connected to the brace.

12. A ladder stabilizing tool comprising:

a brace having left and right sides defining a lateral direction therebetween;

a ladder grasping assembly having a selectively variable lateral length coupled to the brace;

wherein the brace releasably engages a roof and the ladder grasping assembly releasably engages a ladder adjacent a rung to stabilize an upper portion of the ladder relative to the roof;

a fixed first support block on the ladder grasping assembly having a tapered portion configured to be slidably received by a hole defined by the rung on the ladder;

a moveable second support block on the ladder grasping assembly having a tapered portion configured to be slidably received by an opposed hole defined by the rung on the ladder opposite the first support block;

a rigid member extending laterally from the moveable second support block to an end, wherein the rigid member moves in unison with the second support block;

a spring having two ends, a first end of the spring connected to the rigid member, and the spring operatively connected to the fixed first support block;

a t-block connected to the first support block;

a second end of the spring connected to the t-block;

a tubular member having a bore, wherein the rigid member, the spring, and the t-block are disposed within the bore; and wherein the tubular member is rigidly connected to the brace.

* * * * *